US008074824B1

(12) United States Patent
Roby-Wilson

(10) Patent No.: US 8,074,824 B1
(45) Date of Patent: Dec. 13, 2011

(54) TRASH RECEPTACLE APPARATUS

(76) Inventor: Christine M. Roby-Wilson, Charleston, SC (US)

( * ) Notice: Subject to any disclaimer, the term of this patent is extended or adjusted under 35 U.S.C. 154(b) by 614 days.

(21) Appl. No.: 12/253,199

(22) Filed: Oct. 16, 2008

(51) Int. Cl.

| | |
|---|---|
| ***B65D 25/14*** | (2006.01) |
| ***B65D 35/14*** | (2006.01) |
| ***A47G 19/00*** | (2006.01) |
| ***A63B 55/08*** | (2006.01) |

(52) U.S. Cl. ..... 220/495.08; 220/495.05; 220/23.86; 248/98

(58) Field of Classification Search ..... 220/495.08, 220/495.05, 495.06, 908, 908.1, 908.3, 511, 220/23.85, 527, 23.4, 475; 248/97–99; 141/316, 141/390; 200/511; 232/43.1
See application file for complete search history.

(56) References Cited

U.S. PATENT DOCUMENTS

| | | | | |
|---|---|---|---|---|
| 3,817,448 | A | 6/1974 | Schneider | |
| 3,831,959 | A | 8/1974 | Fontana | |
| 3,893,615 | A | 7/1975 | Johnson | |
| 3,917,107 | A * | 11/1975 | Bottas et al. | 141/390 |
| 4,109,571 | A * | 8/1978 | Difley et al. | 100/35 |
| 4,577,778 | A * | 3/1986 | Kim | 220/495.07 |
| 4,923,080 | A | 5/1990 | Lounsbury | |
| 5,048,712 | A * | 9/1991 | Wolters | 220/262 |
| 5,076,458 | A | 12/1991 | Weiner et al. | |
| 5,172,630 | A | 12/1992 | Thompson | |
| 5,176,315 | A * | 1/1993 | Homel | 232/43.2 |
| 5,195,649 | A * | 3/1993 | Wolters | 220/848 |
| 5,361,978 | A | 11/1994 | Monroe | |
| 5,381,921 | A * | 1/1995 | Bray et al. | 220/495.08 |
| 5,901,872 | A | 5/1999 | Zollinhofer et al. | |
| 5,984,134 | A | 11/1999 | Mario | |
| 6,241,115 | B1 * | 6/2001 | Delmerico et al. | 220/495.06 |
| 6,446,919 | B1 * | 9/2002 | Tsui | 248/100 |
| 6,491,264 | B1 * | 12/2002 | Valesquez | 248/97 |
| D542,497 | S | 5/2007 | Orgna et al. | |
| 7,604,143 | B2 * | 10/2009 | Kerekes, Jr. | 220/495.08 |
| 2009/0194540 | A1 * | 8/2009 | Dembowiak et al. | 220/495.06 |

* cited by examiner

*Primary Examiner* — Bryon Gehman
*Assistant Examiner* — Shawn Braden

(57) ABSTRACT

A trash receptacle apparatus comprising a first vertical pole, a second vertical pole, a third vertical pole, a fourth vertical pole, a first top bar, a second top bar, a third top bar, a fourth top bar, a first roller pole, a second roller pole, a third roller pole, a fourth roller pole, and a base wherein the poles and base altogether form a frame; a housing for temporarily enclosing the frame; and a plurality of wheel disposed on the bottom panel; wherein a trash bag can be folded over the top poles; wherein a user can pull the trash bag out of the trash receptacle apparatus through the frame without having to lift the trash bag above the trash receptacle apparatus.

4 Claims, 5 Drawing Sheets

TRASH RECEPTACLE APPARATUS

FIELD OF THE INVENTION

The present invention is directed to a trash receptacle. More particularly, the present invention is directed to a trash receptacle having a frame inside a housing, wherein a user can remove trash bag without lifting the trash bag above the trash receptacle.

BACKGROUND OF THE INVENTION

The present invention features a trash receptacle apparatus for allowing a user to pull a trash bag out of the trash receptacle apparatus without having to lift the trash bag above the trash receptacle apparatus.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Figure 1:
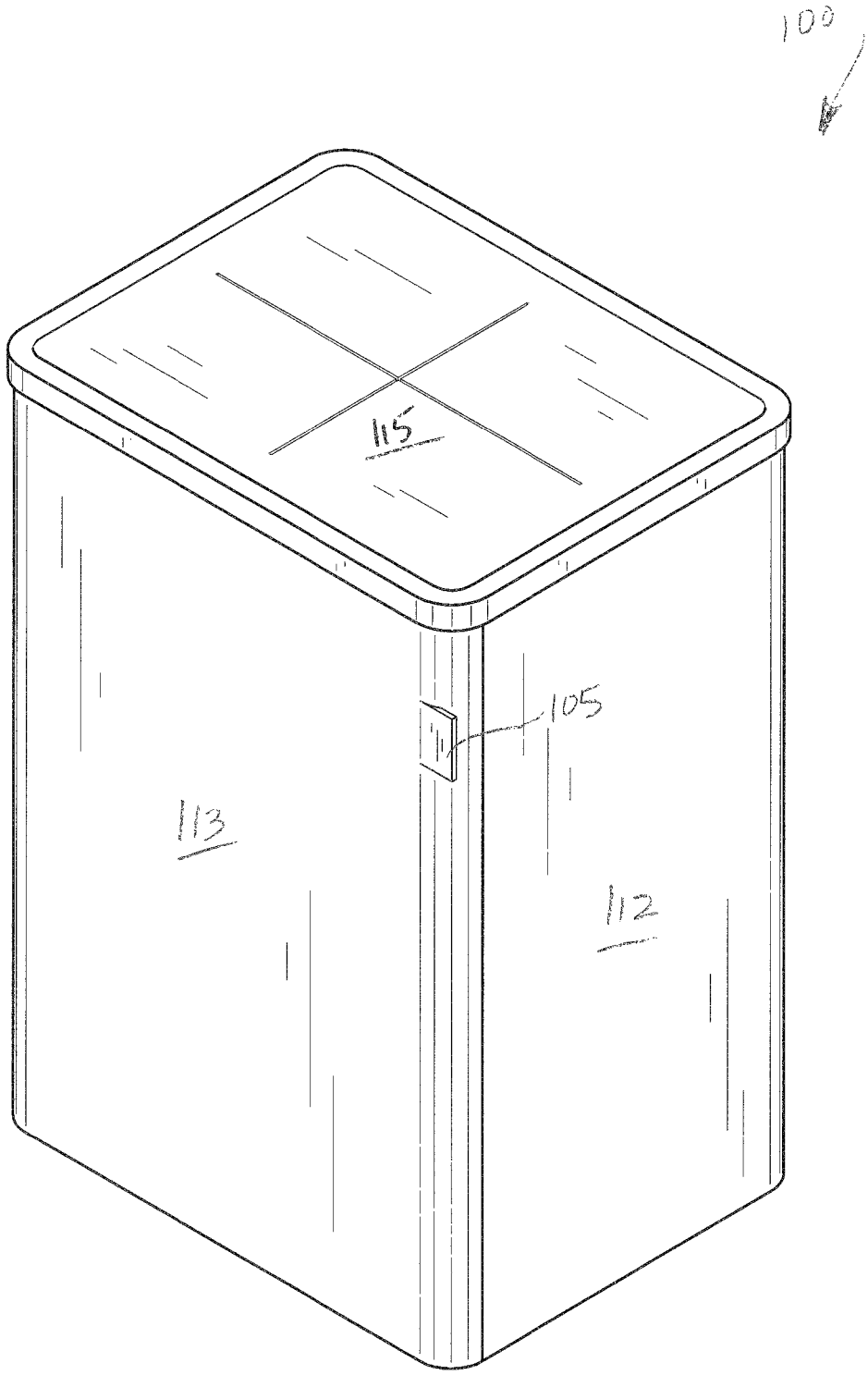
FIG. 1 is a perspective view of the trash receptacle apparatus of the present invention.
Figure 2:
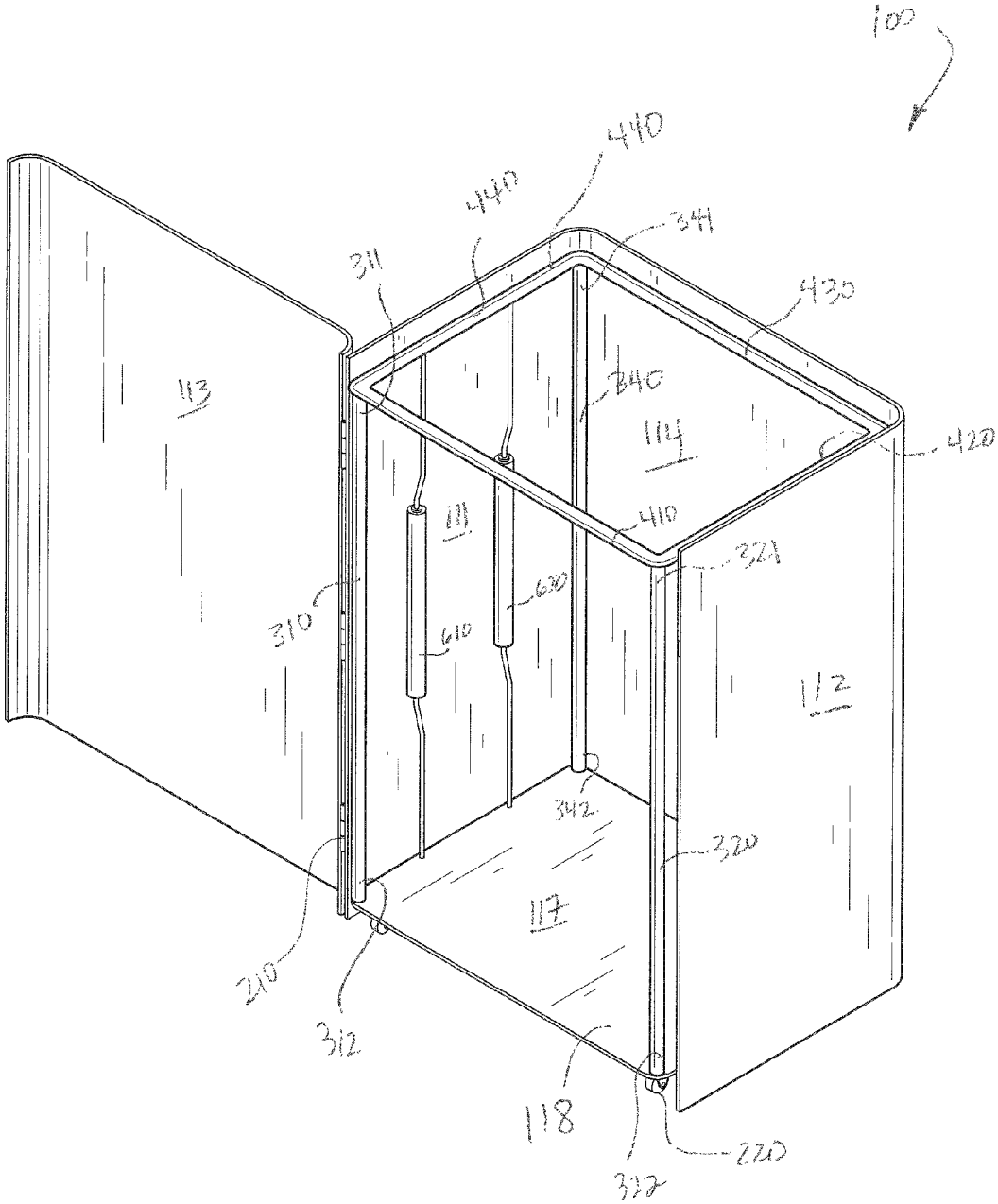
FIG. 2 is a perspective view of the trash receptacle apparatus of the present invention.
Figure 3:
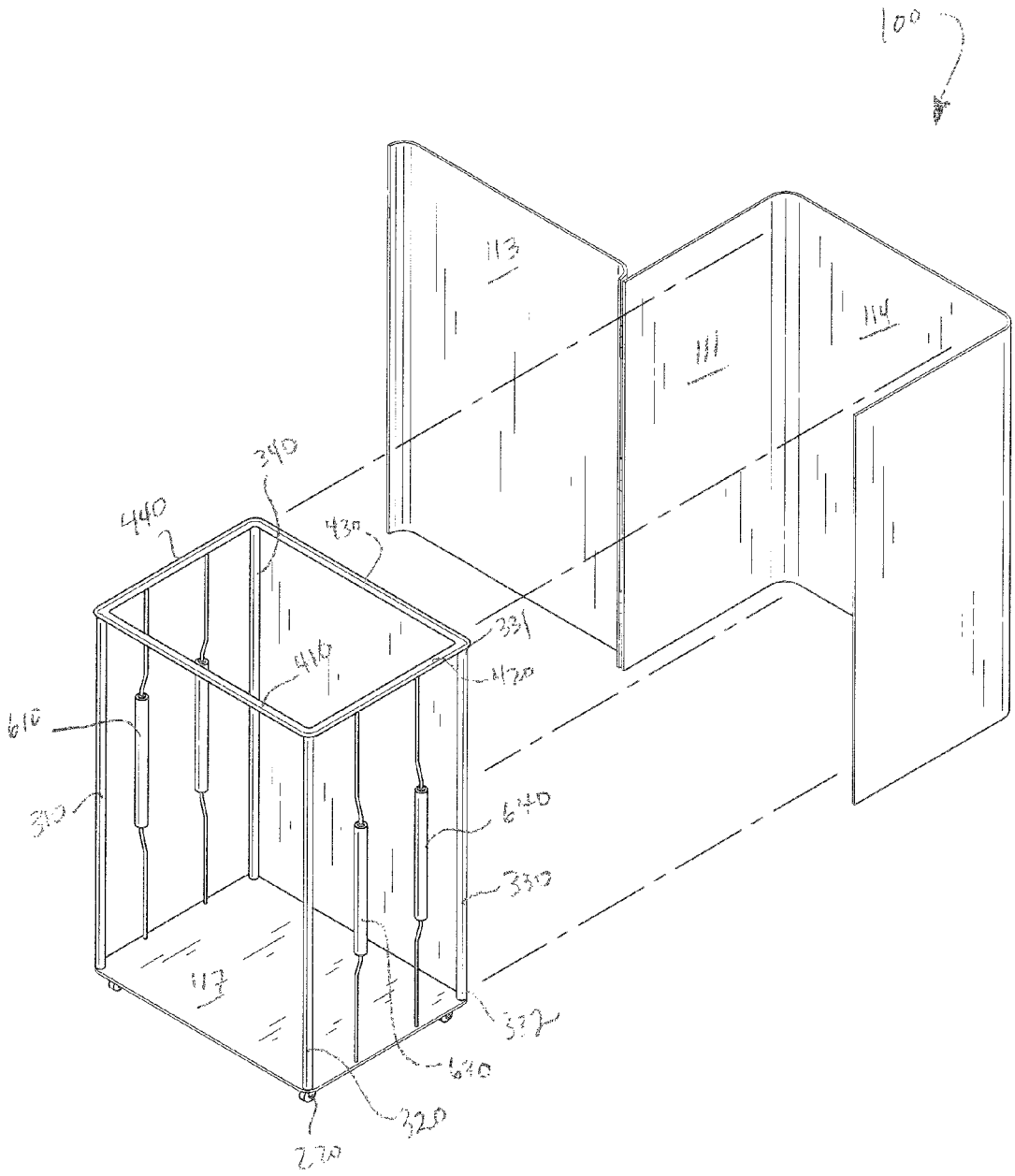
FIG. 3 is a perspective view of the trash receptacle apparatus of the present invention.
Figure 4:
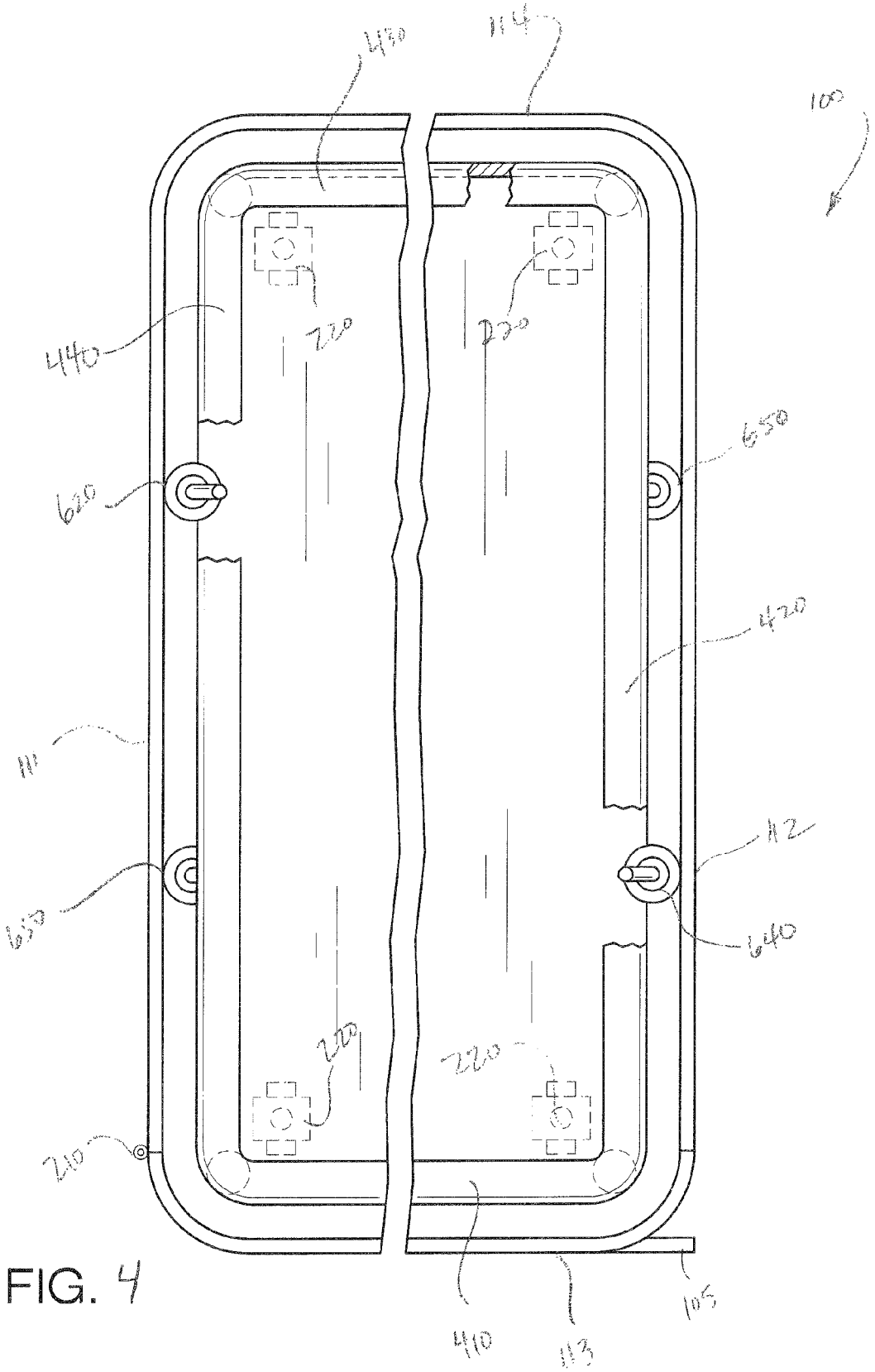
FIG. 4 is a top and cross sectional view of the trash receptacle apparatus of the present invention.
Figure 5:
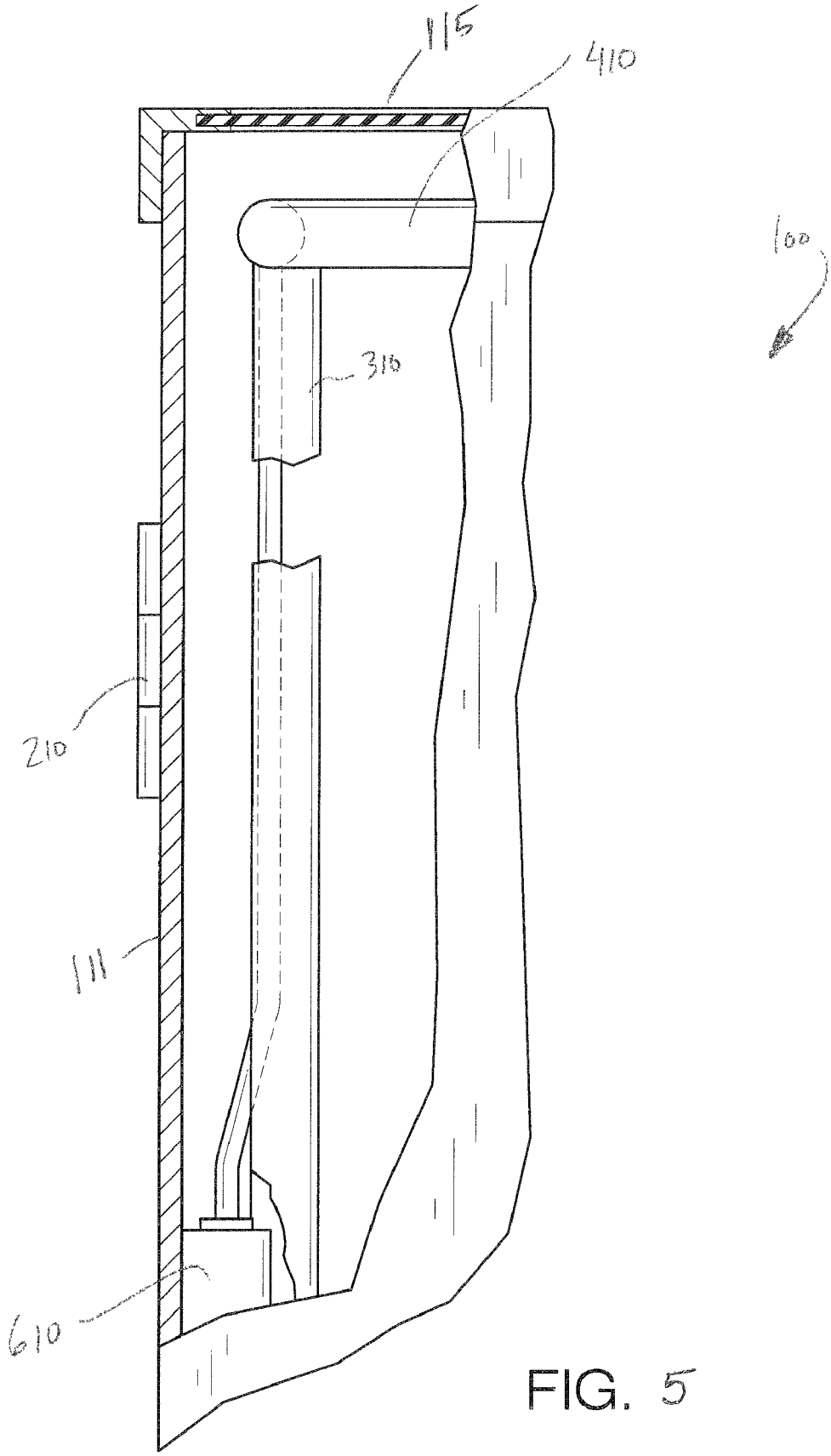
FIG. 5 is a side and cross sectional view of the trash receptacle apparatus of the present invention.

Referring now to FIG. 1-5, the present invention features a trash receptacle apparatus 100 for allowing a user to pull a trash bag out of the trash receptacle apparatus 100 without having to lift the trash bag above the trash receptacle apparatus 100.

The trash receptacle apparatus 100 comprises a frame having a first vertical pole 310 having a first end 311 and a second end 312, a second vertical pole 320 having a first end 321 and a second end 322, a third side pole 330 having a first end 331 and a second end 332, and a fourth vertical pole 340 having a first end 341 and a second end 342. The vertical poles are oriented vertically with respect to the ground surface. A first top bar 410 connects the first end 311 of the first vertical pole 310 to the first end 321 of the second vertical pole 320. A second top bar 420 connects the first end of the second vertical pole to the first end of the third side pole. A third top bar 430 connects the first end of the third side pole to the first end of the fourth vertical pole. A fourth top bar 440 connects the first end of the fourth vertical pole to the first end of the first vertical pole.

The frame is mounted atop a bottom panel 117 having a top surface 118 and a bottom surface. The second end 312 of the first vertical pole 310, the second end 322 of the second vertical pole 320, the second end 332 of the third vertical pole 330, and the second end 332 of the fourth vertical pole 340 are all attached to the top surface 118 of the bottom panel 117.

The trash receptacle apparatus 100 further comprises a housing having a first side panel 111, a second side panel 112, a front panel 113, and a back panel 114. A top panel 115 is removably attached to the housing. The front panel 113 pivotally attached to the first side panel 111 via an attachment means (e.g., a hinge 210). The front panel 113 can move between an open position and a closed position. In the open position, the front panel 113 does not come in contact with the second side panel 112. In the closed position, the front panel 113 comes in contact with the second side panel 112. In some embodiments, a latch 105 is disposed on the front panel 113 to allow the front panel 113 to be secured in the closed position.

In some embodiments, the hinge 210 is disposed on the first side panel 111 and the latch 105 attached to the second side panel 112. This allows for the front panel 113 to be opened widely and allows enough space for the frame to be moved in and out of the housing.

The housing is for temporarily enclosing the frame. Disposed on the bottom surface of the bottom panel 117 is a plurality of wheels 220. The wheels 220 allow the frame to be moved into or out of the housing. For example, when the front panel 113 is in the open position, a user can wheel the frame in or out of the housing.

In some embodiments, the top of an open trash bag can be folded over the first top pole 410, second top pole 420, third top pole 430, and fourth top pole 440 of the frame.

In some embodiments, the frame further comprises a first roller pole 610 having a first end, a second end, and a middle portion. In some embodiments, the first end of the first roller pole 610 is attached to the fourth top bar 440 and the second end of the first roller pole 610 is attached to the bottom panel 117. In some embodiments, the frame further comprises a second roller pole 620 having a first end, a second end, and a middle portion. In some embodiments, the first end of the second roller pole 620 is attached to the fourth top bar 440 and the second end of the second roller pole 620 is attached to the bottom panel 117.

In some embodiments, the frame further comprises a third roller pole 630 having a first end, a second end, and a middle portion. In some embodiments, the first end of the third roller pole 630 is attached to the second top bar 420 and the second end of the third roller pole 630 is attached to the bottom panel 117. In some embodiments, the frame further comprises a fourth roller pole 640 having a first end, a second end, and a middle portion. In some embodiments, the first end of the fourth roller pole 640 is attached to the second top bar 420 and the second end of the fourth roller pole 640 is attached to the bottom panel 117.

Disposed in the middle portion of the first roller pole 610 is a rolling component. Disposed in the middle portion of the second roller pole 620 is a rolling component. Disposed in the middle portion of the third roller pole 630 is a rolling component. Disposed in the middle portion of the fourth roller pole 640 is a rolling component. The rolling components help to allow the frame move in or out of the housing.

In some embodiments, the frame is temporarily secured to the housing via magnets 650. In some embodiments, the magnets 650 are disposed on the rolling component.

In some embodiments, the top panel 115 is pivotally attached to the first side panel 111 and/or second side panel 112 via a hinge mechanism.

The trash receptacle apparatus 100 may be constructed from a variety of materials. For example, in some embodiments, the trash receptacle apparatus 100 is constructed from a material comprising a metal, a plastic, a rubber, the like, or a combination thereof.

In some embodiments, a plurality of flaps are attached to the first top pole 410, second top pole 420, third top pole 430, and/or fourth top pole 440. In some embodiments, the flaps can be pushed down into the receptacle apparatus 100 from a center point.

In some embodiments, the wheels 220 are standard caster-type wheels well known to one of ordinary skill in the art.

The disclosures of the following U.S. patents are incorporated in their entirety by reference herein: U.S. Pat. No. 4,923,080; U.S. Pat. No. 5,901,872; U.S. Pat. No. 5,361,978; U.S. Pat. No. 3,817,448; U.S. Pat. No. 3,893,615; U.S. Pat. No. 5,984,134; U.S. Pat. No. 5,076,458; U.S. Pat. No. 5,172,630; U.S. Pat. No. 3,831,959.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A trash receptacle apparatus comprising:

(a) a first vertical pole having a first end and a second end; a second vertical pole having a first end and a second end; a third vertical pole having a first end and a second end; a fourth vertical pole having a first end and a second end;

(b) a first top bar connecting the first end of the first vertical pole to the first end of the second vertical pole; a second top bar connecting the first end of the second vertical pole to the first end of the third side pole; a third top bar connecting the first end of the third side pole to the first end of the fourth vertical pole; a fourth top bar connecting the first end of the fourth vertical pole to the first end of the first vertical pole;

(c) a first roller pole having a first end, a second end, and a middle portion; wherein the first end of the first roller pole is attached to the fourth top bar and the second end of the first roller pole is attached to the bottom panel;

(d) a second roller pole having a first end, a second end, and a middle portion; wherein the first end of the second roller pole is attached to the fourth top bar and the second end of the second roller pole is attached to the bottom panel;

(e) a third roller pole having a first end, a second end, and a middle portion; wherein the first end of the third roller pole is attached to the second top bar and the second end of the third roller pole is attached to the bottom panel;

(f) a fourth roller pole having a first end, a second end, and a middle portion; wherein the first end of the fourth roller pole is attached to the second top bar and the second end of the fourth roller pole is attached to the bottom panel; wherein the first vertical pole, the second vertical pole, the third vertical pole, the fourth vertical pole, the first top bar, the second top bar, the third top bar, the fourth top bar, the first roller pole, the second roller pole, the third roller pole, and the fourth roller pole altogether form a frame;

(g) a base having a top surface and a bottom surface, wherein the top surface of the base is attached to the second end of the first vertical pole, the second end of the second vertical pole, the second end of the third side pole, and the second end of the fourth vertical pole;

(h) a housing having a first side panel, a second side panel, and a back panel; wherein the housing is for temporarily enclosing the frame;

(i) a front panel pivotally attached to the first side panel of the housing via a hinge; wherein the front panel can move between an open position and a closed position;

(j) a top panel removably attached to the housing;

(k) a plurality of wheel disposed on the bottom surface of the bottom panel, wherein the wheels allow the frame to be moved into or out of the housing;

(l) a rolling component disposed in the middle portion of the first roller pole, the middle portion of the second roller pole, the middle portion of the third roller pole, and the middle portion of the fourth roller pole; wherein the rolling component is for helping the frame move in or out of the housing;

wherein a trash bag can be folded over the first top pole, second top pole, third top pole, and fourth top pole of the frame; wherein a user can pull the trash bag out of the trash receptacle apparatus through the frame without having to lift the trash bag above the trash receptacle apparatus.

2. The trash receptacle apparatus of claim 1, wherein a latch is disposed on the front panel to allow the front panel to be secured in the closed position.

3. The trash receptacle apparatus of claim 1, wherein the frame is temporarily secured to the housing via a magnet.

4. The trash receptacle apparatus of claim 1, wherein a plurality of flaps is attached to the first top pole, the second top pole, the third top pole, and the fourth top pole; wherein the flaps can be pushed down into the trash receptacle apparatus from a center point.

* * * * *